United States Patent [19]

Molitor

[11] Patent Number: 4,667,617

[45] **Date of Patent: * May 26, 1987**

[54] ROPE-HOLDING BOAT HOOK

[76] Inventor: Jerome A. Molitor, Cherry La., Mendham, N.J. 07945

[ * ] Notice: The portion of the term of this patent subsequent to Dec. 10, 2002 has been disclaimed.

[21] Appl. No.: 788,627

[22] Filed: Oct. 17, 1985

Related U.S. Application Data

[63] Continuation-in-part of Ser. No. 642,694, Aug. 28, 1984, Pat. No. 4,557,214, which is a continuation of Ser. No. 419,959, Sep. 20, 1982, abandoned.

[51] Int. Cl.[4] ..... B63B 21/54

[52] U.S. Cl. ..... 114/221 R; 114/230

[58] Field of Search ..... 114/221 R, 230; 411/400; 294/19.1

[56] References Cited

U.S. PATENT DOCUMENTS

| | | | |
|---|---|---|---|
| 842,933 | 2/1907 | Bement | 114/221 R |
| 2,811,127 | 10/1957 | Palsson | 114/221 R |
| 3,431,568 | 3/1969 | Brown | 114/230 |
| 3,828,716 | 8/1974 | Bernardi | 114/221 R |
| 3,861,346 | 1/1975 | Pina | 114/221 R |
| 3,878,808 | 4/1975 | Mock | 114/230 |
| 3,918,385 | 11/1975 | Wallace | 114/230 |
| 3,993,013 | 11/1976 | Nunziato | 114/221 R |
| 4,261,280 | 4/1981 | Collic, Sr. | 114/221 R |

*Primary Examiner*—Jeffrey V. Nase
*Assistant Examiner*—Paul E. Salmon
*Attorney, Agent, or Firm*—Rey Eilers

[57] ABSTRACT

Rope-supporting members are secured to a boat hook at spaced points along the length of the forward portion of that boat hook; and each of those rope-holding members has a shank and a bent end. That boat hook will be rotated about its axis to dispose those rope-holding members in position to support two spaced parts of a loop which is adjacent one end of a rope; and then those two spaced parts of that loop will be draped over those rope-holding members. An elongated part of that loop will depend downwardly below the level of the forward portion of the boat hook; and movement of that forward portion in a given direction will move that downwardly-depending elongated part of that loop into engagement with one side of a piling or other mooring device, continued movement of that forward portion of that boat hook in that given direction will move the two spaced parts of that loop over and beyond the other side of that piling or other mooring device, and rotation of that boat hook about its axis will move the bent ends of the rope-holding elements downwardly until they release the two spaced parts of that loop and thereby permit those two spaced parts of that loop to respond to gravity to fall down on the other side of that piling or other mooring device.

7 Claims, 8 Drawing Figures

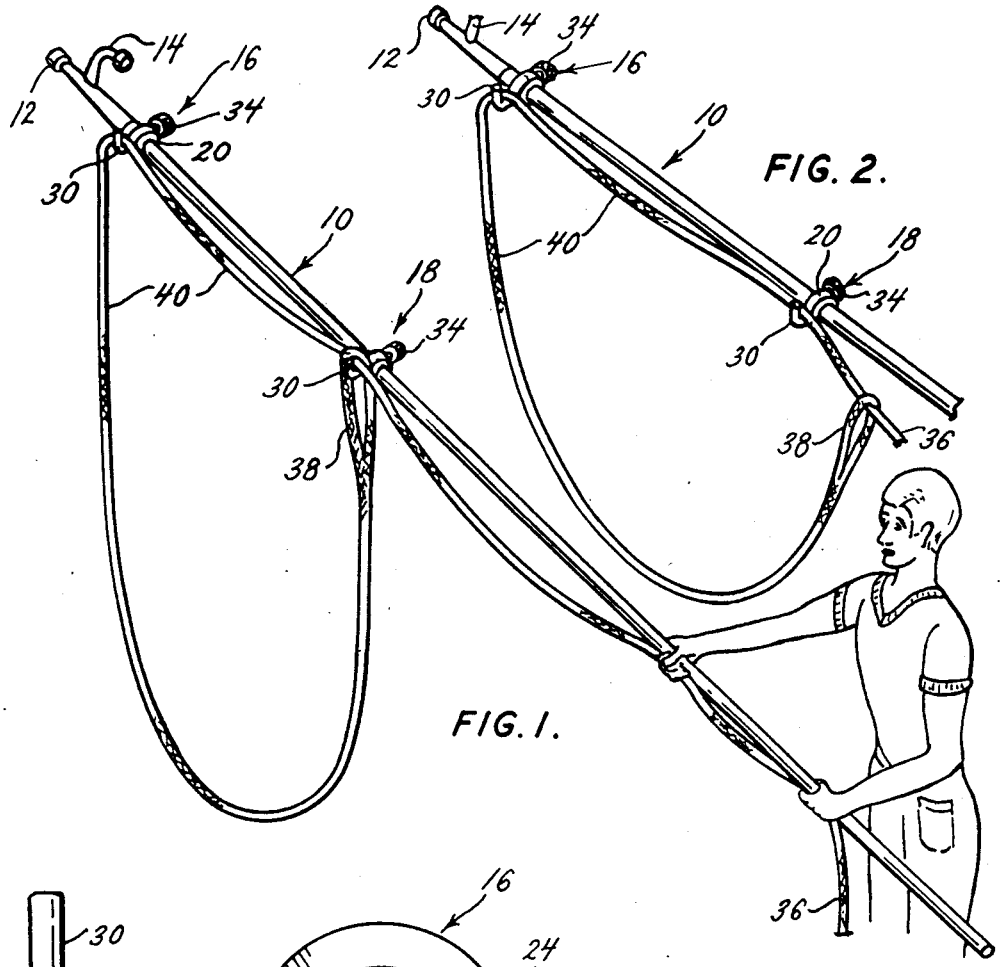
FIG. 1.
FIG. 2.
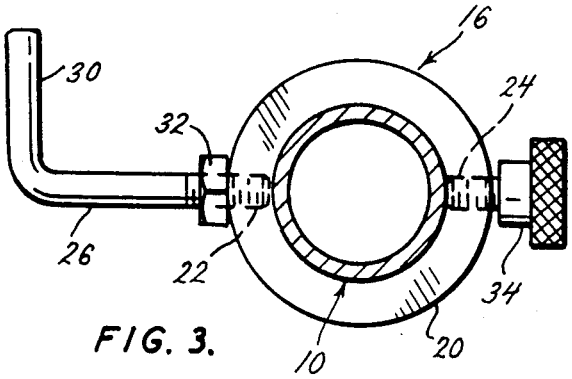
FIG. 3.
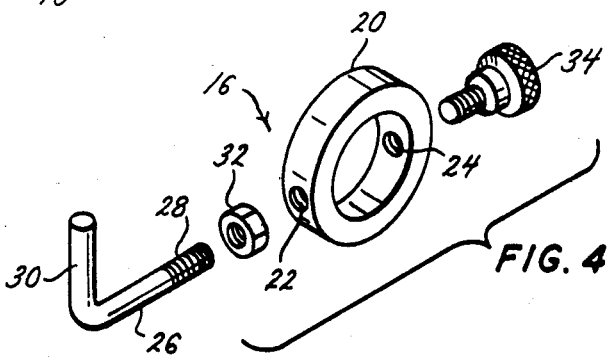
FIG. 4.

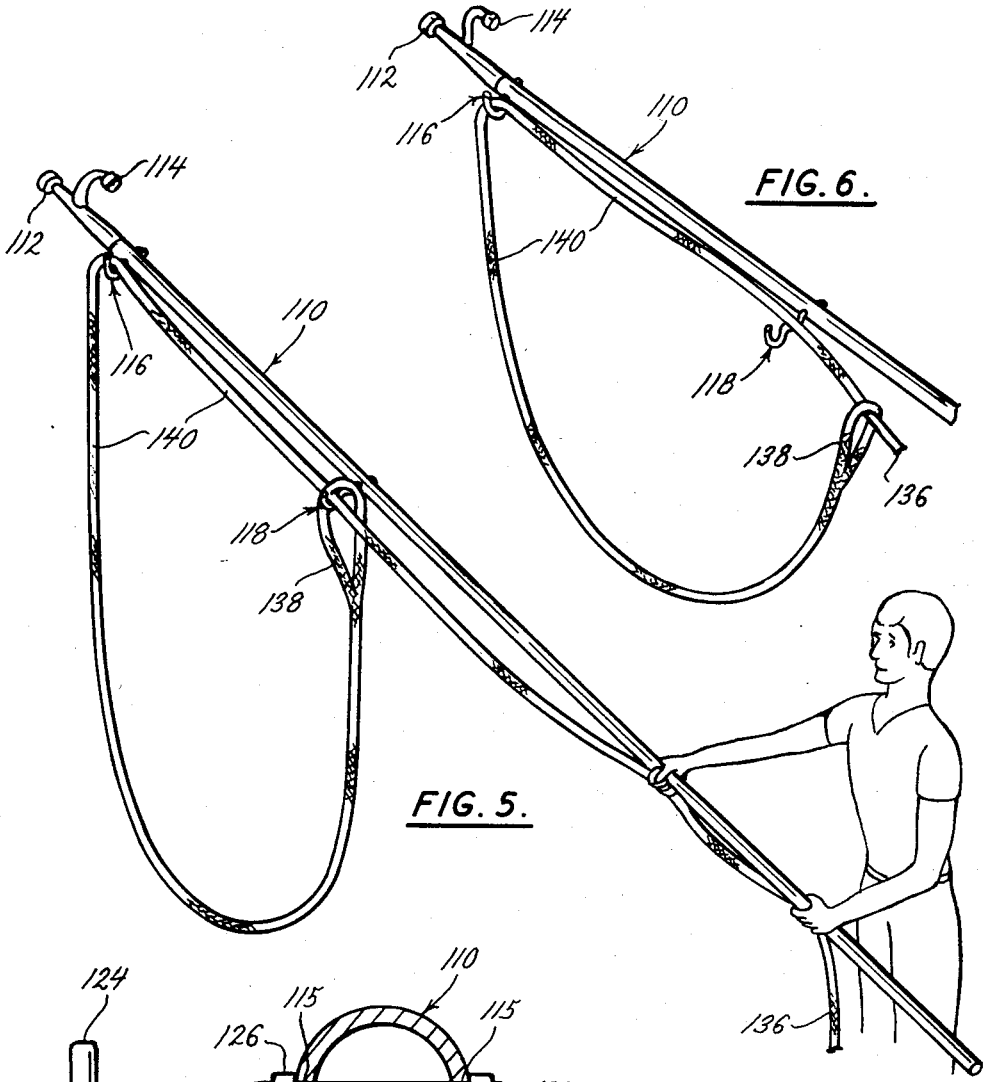
FIG. 6.
FIG. 5.
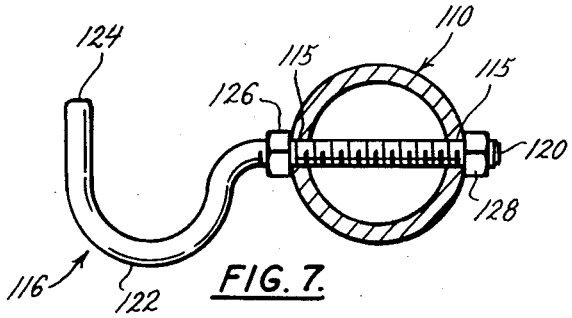
FIG. 7.
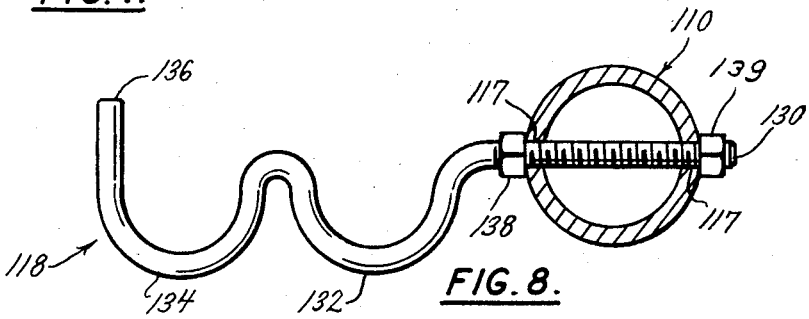
FIG. 8.

ROPE-HOLDING BOAT HOOK

PRIOR APPLICATIONS

This is a continuation-in-part of my copending application Ser. No. 06/642,694 now U.S. Pat. No. 4,557,214, patented Dec. 10, 1985, for ROPE-HOLDING BOAT HOOK which was filed on Aug. 28, 1984 as a continuation of my application Ser. No. 06/419,959 for ROPE-HOLDING BOAT HOOK which was filed on Sept. 20, 1982, now abandoned.

BACKGROUND OF THE INVENTION

When a boat is to be moored, it is customary to place a loop, adjacent one end of a rope, over a piling or other mooring device. In many instances, a crew member positions himself or herself close to the bow of the boat, and then either reaches beyond the side of the boat to drape that loop over that piling or other mooring device, or attempts to throw that loop over that piling or other mooring device. Reaching beyond the side of the boat can be both dangerous and uncomfortable; and the throwing of a loop can, unless the crew member is skillful in throwing ropes, involve a good deal of time and frustration.

DESCRIPTION OF THE PRIOR ART

A number of devices have been proposed to simplify the telescoping of a loop, adjacent one end of a rope, over a piling or other mooring device. Some of those devices have been specially-designed boat hooks; and other of those devices have been boat hooks with rope-holding attachments. However, none of those devices has met wide-spread acceptance.

SUMMARY OF THE INVENTION

A boat hook has a rope-holding member adjacent the forward end thereof and has a second rope-holding member intermediate the first rope-holding member and the rear of the boat hook. The boat hook is rotatable about its axis to enable two spaced parts of a loop, which is adjacent one end of a rope, to be draped around those rope-holding members so an intervening part of that loop can depend downwardly below the level of the boat hook. The forward portion of the boat hook can be moved in a given direction to move the downwardly-depending part of the loop into engagement with one side of a piling or other mooring device, continued movement of that forward portion of that boat hook in that given direction will move the two spaced parts of that loop over and beyond the other side of that piling or other mooring device, and then rotation of that boat hook about its axis will move the rope-holding elements downwardly until they release the two spaced parts of that loop and thereby permit those two spaced parts of that loop to respond to gravity to fall down on the other side of that piling or other mooring device.

Other and further objects and advantages of the present invention should become apparent from an examination of the drawing and accompanying description.

In the drawing and accompanying description, two preferred embodiments of the present invention are shown and described but it is to be understood that the drawing and accompanying description are for the purpose of illustration only and do not limit the invention and that the invention will be defined by the appended claims.

BRIEF DESCRIPTION OF THE DRAWING

In the drawing,

FIG. 1 is a perspective view of one preferred embodiment of boat hook which is being used to support a loop in the end of a rope;

FIG. 2 is a perspective view of part of the boat hook of FIG. 1 and of part of a larger loop which is being supported by that boat hook;

FIG. 3 is a sectional view, on a larger scale, through the boat hook of FIG. 1 and it shows one of the rope-supporting members of that boat hook;

FIG. 4 is an exploded view, on a scale intermediate those of FIGS. 1 and 3, of the rope-supporting member of FIG. 3;

FIG. 5 is a perspective view of another preferred embodiment of rope hook which is being used to support a loop in the end of a rope;

FIG. 6 is a perspective view of part of the boat hook of FIG. 5 and of part of a larger loop which is being supported by that boat hook;

FIG. 7 is a cross sectional view, on a larger scale, through the boat hook of FIG. 5 and it shows one of the rope-supporting members of that boat hook; and FIG. 8 is a cross sectional view, on the scale of FIG. 7, through the boat hook of FIG. 5 and it shows the other rope-supporting member of that boat hook.

DETAILED DESCRIPTION OF PREFERRED EMBODIMENTS

Referring to FIGS. 1–4 of the drawing in detail, the numeral 10 generally denotes a boat hook of standard and usual design which is equipped with a fending tip 12 and a hook portion 14 which is adjacent that tip. As indicated particularly by FIG. 3, that boat hook is tubular in construction, but, where desired, it could be made solid. The design, size and material used in making the boat hook 10 are not, per se, parts of the present invention; and any standard and usual boat hook could be used.

The numeral 16 denotes a rope-supporting member which is mounted on the forward portion of the boat hook 10, and the numeral 18 denotes a similar rope-supporting member which is mounted on that boat hook at a point which is intermediate the rope-supporting member 16 and the rear end of that boat hook. The preferred form of those rope-supporting members is shown by FIGS. 3 and 4; and it includes a collar 20 that is dimensioned to telescope readily over the rear end of the boat hook 10. A threaded socket 22 extends radially inwardly from one portion of the periphery of that collar, and a threaded opening 24 extends radially inwardly from a circumferentially-spaced portion of that periphery. Although that recess and opening are shown on the same diameter, they could be disposed at various angles relative to each other. The numeral 26 denotes a straight shank which has a threaded inner end 28 and a bent outer end 30. That threaded inner end is dimensioned to extend into, and to be held by, the threaded recess 22. A nut 32 is dimensioned to be threaded onto the threaded end 28 and to serve as a lock nut. The numeral 34 denotes a knurled locking bolt which has a threaded inner end that is held by the threaded opening 24. To minimize the cost of machining the collar 16, the recess 22 can be an opening which extends through to the inner periphery of that collar and is coaxial with the opening 24.

The rope-supporting members 16 and 18 can be set at desired points along the length of the boat hook 10. However the rope-supporting member 16 preferably is close to the forward end of the boat hook 10 but is spaced far enough rearwardly from the hook portion 14 to enable that hook portion to perform its intended purpose and function. The rope-supporting member 18 is displaced far enough rearwardly from the rope-supporting member 16 to enable a desirably-large loop to be held by those rope-supporting members.

The numeral 36 denotes a rope of the type that is customarily used to moor a small boat. A small loop 38 is formed in one end of that rope, and the other end of that rope is passed through that small loop to define a large loop 40. The shank 26 of the rope-supporting member 18 is long enough to directly support the small loop 38 plus the portion of rope 36 which extends through that small loop. As a result, the rope-supporting members 16 and 18 can be used to directly support a large loop 40 with a fixed width. If desired, however, the small loop 38 could be disposed rearwardly of the rope-supporting member 18, as shown particularly by FIG. 2. Where that was done, the shank of the rope-supporting member 18 would directly support only a portion of the rope 36 and would not directly support the loop 38. If desired, the small loop 38 could be held by the rope-supporting member 18 and the portion of rope 36 which passes through that small loop could rest adjacent the bottom of that small loop.

In using the boat hook provided by the present invention, a large loop 40 is provided in the rope 36; and two spaced portions of that loop will be draped on the upper sides of the shanks of the rope-supporting members 16 and 18. As shown by FIGS. 1 and 2, the large intervening portion of that loop, between those rope-supporting members, will depend downwardly from the lower sides of those shanks. As the boat approaches a piling or other mooring device, a crewman can extend the boat hook 10 outwardly and forwardly toward that piling or other mooring device while holding the forward portion of that boat hook above the level of the top of that piling or other mooring device but close enough to that level to enable the lower portion of the large loop 40 to be disposed below the top of that piling or other mooring device. The movement of the boat, or the crewman, will then move the boat hook 10 horizontally toward the piling or other mooring device until the lower portion of the loop 40 engages one side of that piling or other mooring device, and will continue to move the forward portion of that boat hook in that direction until the two spaced points of that loop pass over and beyond the opposite side of that piling or other mooring device, and then the crewman will rotate the boat hook in the counterclockwise direction about its axis until the shanks 26 and bent ends 30 of the rope-supporting members 16 and 18 release the two spaced portions of that loop. Thereupon, those two spaced portions, and the short length of rope 36 therebetween, will fall downwardly on the opposite side of the piling or other mooring device to completely encircle that piling or other mooring device. It will be noted that in using the boat hook of the present invention, the crewman does not have to lean outwardly beyond the side of the boat and does not have to try to cast the loop 40 over the top of the piling or other mooring device. Instead, the crewman can stand in a relaxed, erect position and use the boat hook 10 to move the loop 40 into position where it encircles the piling or other mooring device.

Where the rope-supporting members 16 and 18 are made as collars which can be readily telescoped over the inner end of a boat hook, they can be set at any desired points along the length of that boat hook. Also, they can be used with any standard and usual boat hook, and do not require a specially-machined, specially-fabricated or specially-designed boat hook. However, if desired, the rope-supporting members 16 and 18 could be permanently secured to the boat hook 10, as by being riveted, welded, or bolted to that boat hook. It should be noted that whether the rope-supporting members 16 and 18 are in the form of selectively-securable collars or are in the form of permanently-secured members, they act as portions of the boat hook.

If the rope-supporting members 16 and 18 were to be permanently attached to the boat hook 10, they could be made in different forms. For example, those rope-supporting members could be made as shanks which had the inner ends thereof directly secured to the boat hook. Bent ends are desirable, but they are not essential, for the shanks of the rope-supporting members; whether those rope-supporting members include releasably-securable collars or are permanently secured to the boat hook. Specifically, if the rope-supporting members had surfaces that were displaced outwardly from the same side of a boat hook, and if that boat hook was positioned so those surfaces extended vertically upwardly from that boat hook, two portions of the loop 40 could be disposed at one side of those surfaces, the immediately-adjacent portions of that loop could be draped over the sections of that boat hook which were immediately adjacent those surfaces, and the major portion of the loop 40 could depend downwardly in a generally-vertical plane from the opposite sides of those surfaces. To release that loop, the boat hook would be rotated about its axis until those surfaces were moved down far enough to enable those surfaces to release the two portions of loop 40.

If desired, the hook portion 14 could be used as one rope-supporting member, and a second rope-supporting member could be positioned in the area which is occupied by the rope-supporting member 18. In that event, the rope-supporting surface of the second rope-supporting member would preferably lie in, or be close to, the plane which is defined by the hook portion 14, and that surface would extend from the same side of the boat hook from which that hook portion extends. In using a boat hook equipped with such rope-supporting members, the hook portion 14 and the rope-supporting surface of the second rope-supporting member would be set close to the vertical, two spaced portions of the loop 40 would be set at the same sides of that hook portion and of that rope-supporting surface, the adjacent portions of that loop would be draped over the adjacent sections of the boat hook, and the major portion of that loop would depend downwardly in a generally-vertical plane from the opposite sides of that hook portion and of that rope-supporting surface. After the forward portion of the boat hook had been used to move the lower portion of that loop against one side of a piling or other mooring device, the forward portion of that boat hook would be used to move those two spaced portions of that loop over and beyond the other side of that piling or other mooring device, and then that boat hook would be rotated about its axis until the hook portion 14 and the rope-supporting surface of the second rope-supporting member had been moved down far enough to release the two spaced portions of the loop.

When desired, the collars 20 of the rope-supporting members 16 and 18 could be removed from the boat hook 10 for use on a different boat hook. Further, if desired, those collars could be removed from the boat hook 10 where that boat hook had to be stored in a very narrow place.

Referring to FIGS. 5–8 of the drawing in detail, the numeral 110 generally denotes a boat hook of standard and usual design that is equipped with a fending tip 112 and with a hook portion 114 which is adjacent that fending tip. As indicated particularly by FIGS. 7 and 8, that boat hook is tubular in construction but, where desired, it could be made solid. The design, size and material used in making the boat hook 110 are not, per se, parts of the present invention; and any standard and usual boat hook could be used.

The numeral 115 denotes aligned openings, in the boat hook 110, which are spaced a short distance rearwardly of the hook portion 114. The numeral 117 denotes further aligned openings, in that boat hook, which are spaced rearwardly of the aligned openings 115. The numeral 116 denotes a rope-supporting member which has a threaded shank 120 that is disposed within the aligned openings 115. An abutment or nut 126 on that shank abuts one face of the boat hook 110, and a nut 128 on the free end of that shank abuts the other face of that boat hook. The abutment or nut 126 and the nut 128 will intimately engage those faces of the boat hook, and will thereby hold the rope-supporting member 116 fixed relative to that boat hook. A concave rope-receiving seat 122 is formed in the rope-supporting member 116 intermediate the abutment or nut 126 and the upwardly-extending outer end 124 of that rope-supporting member. The top of that upwardly-extending outer end extends upwardly above the axis of the shank 120.

The numeral 118 denotes a rope-supporting member which has a threaded shank 130 that is disposed within the aligned openings 117. An abutment or nut 138 on that shank abuts one face of the boat hook 110, and a nut 139 on the free end of that shank abuts the outer face of that boat hook. The abutment or nut 138 and the nut 139 intimately engage those faces of the boat hook 110, and will thereby hold the rope-supporting member 118 fixed relative to that boat hook. A pair of contiguous, concave, rope-receiving seats 132 and 134 are formed in the rope-supporting member 118 intermediate the abutment or nut 138 and the upwardly-extending outer end 136 of that rope-supporting member. The top of that upwardly-extending outer end extends upwardly above the axis of the shank 130.

The ropes that are used to moor most pleasure boats range from one-quarter ($\frac{1}{4}$) to five-eighths ($\frac{5}{8}$) of an inch in diameter. The rope-recieving seats 132 and 134 are dimensioned to accommodate ropes that are five-eighths ($\frac{5}{8}$) of an inch in diameter, and hence also can accommodate ropes that are one quarter ($\frac{1}{4}$) of an inch in diameter. The rope-receiving seat 122 also is dimensioned to accommodate ropes that are five-eighths ($\frac{5}{8}$) of an inch in diameter.

As shown particularly by FIGS. 5 and 6, a portion of a loop 140 in rope 136 can nestle within, and be held by, the concave rope-receiving seat 122 of the rope-supporting member 116. A further portion of that same rope can nestle within, and be held by, the concave rope-receiving seat 134 of the rope-supporting member 118. A part of the small loop or "eye" of that rope can, in part, nestle within the concave rope-receiving seat 132 of that rope-supporting member.

The rope-supporting member 116 preferably is close to the forward end of the boat hook 110 but is spaced far enough rearwardly from the hook portion 114 to enable that hook portion to perform its intended purpose and function. The rope-supporting member 118 is displaced far enough rearwardly from the rope-supporting member 116 to enable a desirably-large loop to be held by those rope-supporting members.

The rope-supporting members 116 and 118 are less expensive, and occupy less space, than the rope-supporting members 16 and 18 of FIGS. 1–4. However, the rope-supporting members 116 and 118 are fixed to the boat hook 110; and hence they cannot be shifted to various positions along the length of that boat hook.

In using the boat hook 110, the large loop 140 in the rope 136 will be draped over the rope-supporting members 116 and 118 in substantially the same manner in which the large loop 40 in the rope 36 is draped over the rope-supporting members 16 and 18 in FIGS. 1 and 2. Specifically, as shown by FIGS. 5 and 6, the upper portion of the large loop 140 in the rope 136 will be supported by the rope-supporting members 116 and 118 as the boat hook 110 is moved toward a piling or other mooring device, and part of the small loop or "eye" 138 of that rope will be supported by the rope-supporting member 118. The rope-supporting members 116 and 118 will continue to support the upper portion of the large loop 140 and the small loop or "eye" 138 until the downwardly-depending portion of that loop is at one side of the piling or other mooring device and that upper portion has been moved beyond the far side of that piling or other mooring device. At that time, the crewman will rotate the boat hook 110 far enough in the counterclockwise direction to permit all portions of the rope 136 and of its loop 140 to fall downwardly, so that large loop can surround the piling or other mooring device. In using the boat hook 110, as in using the boat hook 10, the crewman does not have to lean outwardly beyond the side of the boat and does not have to try to cast the loop 140 over the top of the piling or other mooring device. Instead, the crewman can stand in a relaxed, erect position and use the boat hook 110 to move the loop 140 into position where it encircles the piling or other mooring device.

The concave rope-receiving seat 122 of the rope-supporting member 116, and the concave rope-receiving seats 132 and 134 of the rope-supporting member 118 are desirable. However, the rope-supporting members 116 and 118 could be given different configurations and different dimensions—the primary requirements for each of those rope-supporting members being that it be able to coact with the adjacent portion of the boat hook 110 to hold the appropriate portion of loop 140 and/or rope 136 against accidental release as that loop is moved toward a piling or other mooring device, and then promptly respond to rotation of that boat hook to free that loop and/or rope.

If desired, the hook portion 114 could be used as one rope-supporting member, and a second rope-supporting member could be positioned in the area which is occupied by the rope-supporting member 118. In that event, the rope-receiving seats of the second rope-supporting member would preferably lie in, or be close to, the plane which is defined by the hook portion 114; and those seats would extend from the same side of the boat hook from which that hook portion extends. In using a boat hook equipped with such rope-supporting members, the hook portion 114 and the rope-receiving seats of the second rope-supporting member would be set close to the vertical, two spaced portions of the loop 140 would be set at the same sides of that hook portion and of those rope-receiving seats, the adjacent portions of that loop would be draped over the adjacent sections of the boat hook, and the major portion of that loop would depend downwardly in a generally-vertical plane from the opposite sides of that hook portion and of those rope-receiving seats. After the forward portion of the boat hook had been used to move the lower portion of that loop against one side of a piling or other mooring device, the forward portion of that boat hook would be used to move those two spaced portions of that loop over and beyond the other side of that piling or other mooring device, and then that boat hook would be rotated about its axis until the hook portion 114 and the rope-receiving seats of the second rope-supporting member had been moved down far enough to release the two spaced portions of the loop.

The rope-receiving seat 122 effectively constitutes an arcuate portion, of the shank 120 of the rope-supporting member 116, which extends generally horizontally outwardly relative to the axis of the boat hook 110. The rope-receiving seats 132 and 134 effectively constitute arcuate portions, of the shank 130 of the rope-supporting member 118, which extend generally horizontally outwardly relative to the axis of that boat hook. As a result, the rope-supporting members 116 and 118, like the rope-supporting members 16 and 18, effectively have portions which engage a boat hook, further portions that can underlie parts of a loop in a rope, and further portions which extend upwardly and coact with the boat hook to prevent accidental separation of that loop from those rope-supporting members.

The shanks 120 and 130 are shown as being of constant diameter and as being held within aligned openings in the boat hook 110. If desired, those shanks could be made with thread-equipped, progressively smaller-diameter ends so they could be screwed into openings in a wooden or aluminum boat hook. Also, those shanks could be made with pointed ends so they could be driven into openings in a wooden or aluminum boat hook.

Whereas the drawing and accompanying description have shown and described two preferred embodiments of the present invention, it should be apparent to those skilled in the art that various changes may be made in the form of the invention without affecting the scope thereof.

What I claim is:

1. A boat hook which can releasably hold two spaced portions of a loop, that is adjacent one end of a rope, in generally-horizontal relation while permitting an intervening part of that loop to depend downwardly in a generally-vertical plane and which comprises an elongated substantially-straight boat hook, a first rope-supporting means that has a shank which extends generally-horizontally outwardly from one side of said boat hook relative to the axis of said boat hook and that has an outer end which extends upwardly from said shank, and a second rope-supporting means that has a shank which extends generally-horizontally outwardly from said one side of said boat hook relative to said axis of said boat hook and that has an outer end which extends upwardly from said shank, said first and said second rope-supporting means being spaced apart along the length of said boat hook but being close to the forward end of said boat hook, said shank of said first rope-supporting means being disposed below the level of the then-uppermost surface of said boat hook and the upwardly-extending outer end of said first rope-supporting means being close to said one side of said boat hook so said first rope-supporting means holds one of said two spaced portions of said loop immediately adjacent said one side of said boat hook and so said upwardly-extending outer end of said first rope-supporting means and said one side of said boat hook coact to limit lateral movement of said one of said two spaced portions of said loop relative to said axis of said boat hook as long as said boat hook is disposed so said shank of said first rope-supporting means is generally-horizontal and said upwardly-extending outer end thereof is upwardly directed, said shank of said second rope supporting means being disposed below the level of said then-uppermost surface of said boat hook and the upwardly-extending outer end of said second rope-supporting means being close to said one side of said boat hook so said second rope-supporting means holds the other of said two spaced portions of said loop immediately adjacent said one side of said boat hook and so said upwardly-extending outer end of said second rope-supporting means and said one side of said boat hook coact to limit lateral movement of said other of said two spaced portions of said loop relative to said axis of said boat hook as long as said boat hook is disposed so said shank of said second rope-supporting means is generally-horizontal and said upwardly-extending outer end thereof is upwardly directed, said upwardly-extending outer ends of said first and said second rope-supporting means responding to rotation of said boat hook about its axis, in a direction which moves said upwardly-extending outer ends downwardly, to permit said one and said other of said two spaced portions of said loop to respond to gravity to fall off of said shanks of said first and said second rope-supporting means and away from said upwardly-extending outer ends thereof, the shank of at least one of said rope-supporting means being spaced from said one side of said boat hook a distance long enough to releasably support either said one or said other of said two spaced portions of said loop plus a portion of said rope on said shank between said upwardly extending outer end and said side of said boat hook, whereby said first and said second rope-supporting means coact to hold said one and said other of said two spaced portions of said loop plus said portion of said rope while permitting said intervening part of said loop to depend downwardly in a generally-vertical plane as said boat hook is used to move said loop in a given direction toward a piling or other mooring device, and whereby said first and said second rope-supporting means can release said one and said other of said two spaced portions of said loop and said portion of said rope for gravity-induced free fall after said boat hook has been moved further in said given direction to move said one and said other of said two spaced portions of said loop and said portion of said rope beyond said piling or other mooring device and said boat hook has been rotated in said direction about its axis to permit said one and said other of said two spaced portions of said loop and said portion of said rope to respond to gravity to fall off of said shanks of said rope-supporting means and away from said upwardly-extending outer ends thereof, said upwardly-extending outer ends of said rope-supporting means constituting spaced-apart, positive, mechanical, loop-blocking barriers which extend upwardly above the levels of said two shanks, and said one side of said boat hook constituting a continuous, positive, mechanical, loop-blocking barrier for said two spaced portions of said loop, one of said barriers preventing accidental, lateral freeing movement of said two spaced portions of said loop whenever the lower portion of said loop is intercepted and held against further lateral movement by said piling or other mooring device as said boat hook is being used to move said two spaced portions of said loop beyond said piling or other mooring device.

2. A boat hook as claimed in claim 1 wherein said shank of said first rope-supporting member is arcuate in part to provide a rope-receiving seat for a portion of said loop.

3. A boat hook as claimed in claim 1 wherein said shank of said second rope-supporting member has a plurality of contiguous arcuate rope-receiving seats therein for a portion of said loop and for said portion of said rope.

4. A boat hook as claimed in claim 1 wherein said shank of said first rope-supporting member has a portion thereof disposed within said boat hook to permanently secure said first rope-supporting member to said boat hook, wherein said shank of said first rope-supporting member has a second portion thereof adapted to underlie and support a portion of said loop, and wherein both said upper surface of said boat hook and said upwardly-extending outer end of said first rope-supporting member can extend above the level of said shank of said first rope-supporting member to hold said portion of said loop against accidental separation from said first rope-supporting member.

5. A boat hook which has an elongated axis about which it can be rotated, a first rope-supporting means that has a rope-underlying surface which is spaced outwardly from, and which is directed transversely of said axis of said boat hook in a generally-horizontal direction, a second rope-supporting means that has a rope-underlying surface which is spaced outwardly from, and which is directed transversely of, said axis of said boat hook in a generally-horizontal direction, said rope-underlying surfaces of said first and said second rope-supporting means being spaced outwardly from the same side of said boat hook and having a length greater than the thickness of said rope so that said rope is releasably supported thereon, and being generally parallel to each other, said first and said second rope-supporting means being spaced apart along said axis of said boat hook but being close to the forward end of said boat hook, said boat hook being selectively rotatably about said axis of said boat hook to simultaneously dispose said rope-underlying surfaces of both said first and said second rope-supporting means in position to underlie, and thereby support, two spaced parts of a loop which is formed adjacent one end of a rope, said rope-underlying surfaces of said first and said second rope-supporting means being disposable in positions to maintain said spaced parts of said loop and a relatively-short intervening part of said loop close to the level of said forward end of said boat hook as long as said rope-underlying surfaces of said first and second rope-supporting means are held in said positions, said rope-underlying surfaces of said first and second rope-supporting means also supporting a longer part of said loop which depends downwardly from said rope-underlying surfaces of said first and second rope-supporting means and which depends downwardly below the level of said forward end of said boat hook to define an open area, said longer part of said loop responding to lateral movement of said forward end of said boat hook in a given direction to move adjacent one side of a piling or other mooring device, said two spaced parts and said relatively-short intervening part of said loop responding to continued movement of said forward end of said boat hook in said given direction to pass over and beyond the other side of said piling or other mooring device, said boat hook being rotatably about said axis of said boat hook to move said rope-underlying surfaces of said first and second rope-supporting means downwardly relative to said axis of said boat hook to positions wherein said rope-underlying surfaces of said first and second rope-supporting means are unable to continue to support said two spaced parts of said loop, whereupon said two spaced parts and said relatively-short intervening part of said loop will respond to gravity to fall away from said rope-underlying surfaces of said first and second rope-supporting means to fall downwardly on said opposite side of said piling or other mooring device, thereby enabling said loop to completely surround said piling or other mooring device, said rope-underlying surfaces of said first and second rope-supporting means being disposable in positions wherein they constitute spaced-apart, positive, mechanical, loop-blocking barriers for said two spaced portions of said loop and said same side of said boat hook constituting a continuous, positive, mechanical, loop-blocking barrier for said two spaced portions of said loop, one of said barriers preventing accidental, lateral, freeing movement of said two spaced portions of said loop whenever the lower portion of said loop is intercepted and held against further lateral movement by said piling or other mooring device as said boat hook is being used to move said two spaced portions of said loop beyond said piling or other mooring device.

6. A boat hook as claimed in claim 5 wherein said surfaces of said first and second rope-supporting means are shanks which extend outwardly from the same side of said axis of said boat hook.

7. A boat hook which can releasably hold two spaced portions of a loop, that is adjacent one end of a rope, in generally horizontal relation while permitting an intervening part of that loop to depend downwardly in a generally-vertical plane and which comprises an elongated substantially-straight boat hook, a first rope supporting member that is formed and dimensioned to project horizontally outwardly from the axis of said boat hook to underlie, and to provide a rope-receiving seat for, a portion of a loop in a rope, said rope-receiving seat being disposed below the level of the then uppermost surface of said boat hook whenever said first rope-supporting member is generally horizontal, an outer end on said first rope-supporting member that extends upwardly above the level of said rope-receiving seat whenever said first rope-supporting member is generally horizontal and said rope-receiving seat underlies said portion of said loop, said outer end of said first rope-supporting member and said boat hook coacting to constitute positive, mechanical, loop-blocking barriers which alternatively keep said portion of said loop from accidentally slipping off of said rope-receiving seat as the lower part of said intervening portion of said loop is intercepted and held against further lateral movement by said piling or other mooring device while said boat hook is used to move said loop into position over a piling or other mooring device, and a second rope-supporting member that is formed and dimensioned to project horizontally outwardly from said axis of said hook to underlie, and to provide a rope-receiving seat for, a further portion of said loop, said rope-receiving seat of said second rope-supporting member being disposed below said level of said then-uppermost surface of said boat hook whenever said second rope-supporting member is generally horizontal, an outer end on said second rope-supporting member that extends upwardly above said level of said rope-receiving seat whenever said second rope-supporting member is generally horizontal and said rope-receiving seat thereof underlies said further portion of said loop, said outer end of said second rope-supporting member and said boat hook coacting to constitute positive, mechanical, loop-blocking barriers which alternatively keep said further portion of said loop from accidentally slipping off of said rope-receiving seat of said second rope-supporting member as the lower part of said intervening portion of said loop is intercepted and held against further lateral movement by said piling or other mooring device while said boat hook is used to move said loop into position over a piling or other mooring device, said first and said second rope-supporting members extending horizontally outwardly from the same side of said axis of said boat hook, said outer ends of said first and said second rope-supporting members extending in the same direction, said rope-receiving seats of said first and second rope-supporting members having a length greater than the thickness of said rope, whereby said rope is releasably supported thereon.

* * * * *